US005469784A

United States Patent [19]

Hess

[11] Patent Number: 5,469,784

[45] Date of Patent: Nov. 28, 1995

[54] CALENDER ASSEMBLY INCLUDING AN ADDITIONAL ROLL DISPLACED INTO THE PATH OF THE WEB OF MATERIAL

[75] Inventor: Harald Hess, Grünkraut, Germany

[73] Assignee: Sulzer-Escher Wyss GmbH, Ravensburg, Germany

[21] Appl. No.: 233,457

[22] Filed: Apr. 26, 1994

[30] Foreign Application Priority Data

Apr. 29, 1993 [DE] Germany ..... 9306448 U

[51] Int. Cl.[6] ..... B30B 3/04; D21G 1/00

[52] U.S. Cl. ..... 100/93 RP; 100/163 R; 100/173

[58] Field of Search ..... 100/38, 93 RP, 100/161, 162 R, 163 R, 163 A, 164–166, 173

[56] References Cited

U.S. PATENT DOCUMENTS

| | | | |
|---|---|---|---|
| 4,016,030 | 4/1977 | Sobota | 100/93 RP |
| 4,080,890 | 3/1978 | Dreher | 100/162 R |
| 4,128,053 | 12/1978 | Kankaanpää | 100/162 R |
| 4,653,395 | 3/1987 | Verkasalo | 100/38 |
| 4,861,409 | 8/1989 | Hashida et al. | 100/173 |
| 5,033,373 | 7/1991 | Brendel et al. | 100/38 |

FOREIGN PATENT DOCUMENTS

| | | | |
|---|---|---|---|
| 234048 | 4/1911 | Germany | 100/162 R |
| 4105978 | 8/1992 | Germany . | |
| 880438 | 10/1961 | United Kingdom . | |
| 2008645 | 6/1979 | United Kingdom . | |
| 2218434 | 11/1989 | United Kingdom . | |
| 2238556 | 6/1991 | United Kingdom . | |

*Primary Examiner*—Stephen F. Gerrity
*Attorney, Agent, or Firm*—Darby & Darby

[57] ABSTRACT

In a calender assembly for treating a web of material (1) in a nip (4) formed by a pair of press rolls (2, 3), at least one roll (3) is heated. In front of and/or behind the nip (4) there is at least one additional roll (8, 9, 14) which can be displaced into the path of the web of material (1) in such a way that the angle of wrap of the web of material (1) at the heated press roll (3) increases. In this way, easy and quick introduction of the web of material is made possible. Further, the heat losses of the heated roll are reduced.

7 Claims, 1 Drawing Sheet

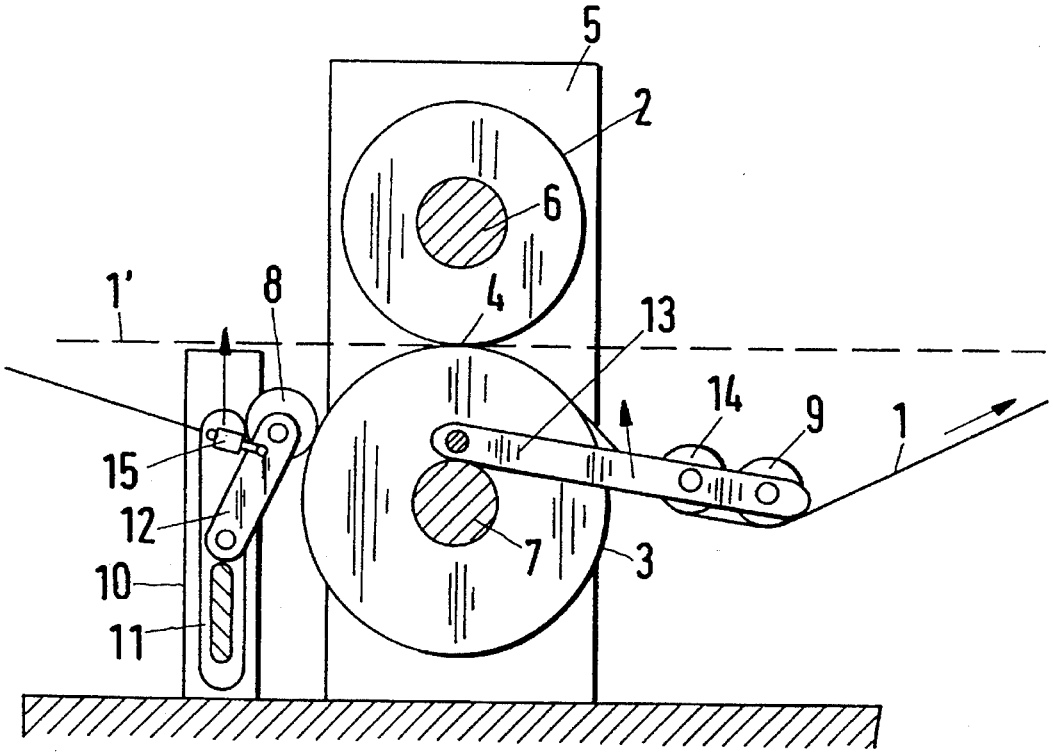
5
2
6
1'
8
4
13
14
9
1
15
12
7
3
10
11

CALENDER ASSEMBLY INCLUDING AN ADDITIONAL ROLL DISPLACED INTO THE PATH OF THE WEB OF MATERIAL

BACKGROUND OF THE INVENTION

1. Field of the Invention

The invention concerns a calender assembly for treating a web of material, in particular a paper web, in a nip formed by a pair of press rolls, wherein at least one roll is heated.

2. Description of the Related Art

In order to allow rapid and unproblematic introduction of the paper web in calenders within a paper-making machine, the paper web runs essentially straight in the region of the calender, i.e. with a very low angle of wrap at the rolls.

To increase the smoothness of paper, often the use of heated rolls in the calender is required. The surface temperatures of over 200° C. which are sometimes necessary in this case result in correspondingly high heat losses due to convection and radiation. For this reason, thermal protective hoods have been developed for the rolls, as known for example from DE-A-4 105 978. The relatively high expenditure is seen as a disadvantage here.

SUMMARY OF THE INVENTION

It is the object of the invention to provide a calender assembly which, in the case of pairs of rolls with at least one heated press roll, allows easy and quick introduction of the web of material and with little expenditure for a given paper quality reduces the heat losses of the heated roll.

According to the invention, the object was achieved by a calender apparatus for treating a web of material in a nip formed by a pair of press rolls, wherein at least one roll is heated, characterised in that in front of and/or behind the nip at least one additional roll can be displaced into the path of the web of material in such a way that the angle of wrap of the web of material at the heated press roll increases.

Owing to the fact that in front of and/or behind the nip at least one roll can be displaced into the path of the web of material in such a way that the angle of wrap of the web of material on the heated roll essentially increases, on the one hand the heat losses due to convection and radiation to the environment are reduced due to the insulating effect of the web of material, and on the other hand it is possible to heat up the web of material already before entering the nip. This in turn results in the fact that the required surface temperature of the heated press roll can be reduced. In this case introduction of the web of material is possible without problems provided that the displaceable rolls are moved out of the path of the web of material, so that essentially straight paper guiding is provided.

In order to ensure a predefined path of the web of material in the region of wrap in front of the nip, it is important to avoid trapped air between the web of material and the heated press roll. It is advantageous here to press the displaceable roll, which is arranged in front of the nip in the direction of travel of the web of material, simultaneously with a weak force which is substantially less than the pressing force, against the heated press roll; as a result, heat transfer between the press roll and the web of material is also improved. It is also possible to provide in front of the nip two rolls, one of which is constructed as a guide roll and pressed against the heated roll, and the other in the form of an expander roll is arranged in front of the guide roll in the direction of travel.

There are also advantages if the displaceable roll is arranged at a distance from the heated roll. The web of material can also easily follow the roll in case of rapid displacement. On the output side it is ensured that the web of material is gradually released from the heated press roll. Behind the nip, an increase in wrap should be used in particular if a further nip follows. Due to the associated increase in temperature of the web of material, the calenderability in the subsequent nip improves.

Furthermore, to improve guiding of the web or the web running characteristics, it may be advantageous if, together with the guide roll which is arranged behind the nip, an expander roll which is arranged between the guide roll and the nip can also be displaced into the path of the web of material.

The angle of wrap can be advantageously at least 20° and preferably 30° to 90° in front of and/or behind the nip. This leads to a substantial wrap with the corresponding positive consequences. The displacement of the guide or expander roll is preferably adjustable for the purpose of adapting the angle of wrap to the web material.

BRIEF DESCRIPTION OF THE DRAWING

Below, the invention will be described in more detail by a practical example. The attached drawing in this case shows a schematic side view of the calender assembly.

DETAILED DESCRIPTION OF THE PREFERRED EMBODIMENTS

As can be seen in this, the web of material (paper web) 1 is guided through a nip 4 formed by two press rolls 2 and 3, wherein the lower press roll 3 is heated. Heating of this press roll 3 can take place from the inside and/or outside. A stand 5 present at both roll ends serves to hold the roll supports 6 and 7.

During introduction, the web of material 1' runs horizontally, which makes this operation very simple. In this case the web of material 1' can be guided over corresponding guide means. During or before treatment of the web of material 1, in each case a roll in the form of a guide roll 8 or 9 arranged in front of and behind the nip 4 as seen in the direction of travel is displaced, in this case lowered, into the path of the web of material 1', so that the angle of wrap of the web of material 1 at the heated press roll 3 changes. In addition to thermal insulation of part of the surface of the heated press roll 3 by the web of material 1, therefore, preheating thereof is also achieved.

In order to prevent air from being drawn in between the web of material 1 and the wrapped press roll 3, the guide roll 8 arranged in front of the nip 4 is simultaneously pressed against the heated press roll 3 during calender treatment. One possible embodiment is offered here by a linear drive 10 which operates at both ends of the guide roll 8 and which can move the frame 11 of the guide roll 8 in a vertical direction. Moreover, at each end of the guide roll 8 there is a lever 12 which carries the guide roll 8 and which is pivotably attached to the frame 11. The pivot angle can in this case be controlled by a piston and cylinder unit 15 mounted on the frame 11 and on the lever 12, so that the contact pressure of the guide roll 8 directed against the heated press roll 3 can be varied.

The guide roll 9 to be found behind the nip 4 is likewise attached at its end in each case to a pivotable lever 13. The pivot point thereof is located more or less in the vicinity of the mounting of the lower roll support 7, wherein the pivot angle can also be controlled by a piston and cylinder unit supported on the stand 5.

To improve the running characteristics of the web of material 1, with the guide roll 9 which is arranged behind the nip 4, an expander roll 14 is also lowered into the path of the web of material 1: fixing of the expander roll 14 takes place here by means of the pivotable lever 13 of the guide roll 9. The use of an expander roll, not shown, in front of the nip 4 also offers advantages.

Lowering of the web of material 1 as well as pressing the guide roll 8 should take place with allowance for the tension of the web of material. Moreover, control of the angle of wrap as a function of the paper quality is recommended.

I claim:

1. Calender assembly for treating a web of material in a nip formed by a pair of press rolls, at least one roll being heated, comprising upstream of the nip, in the direction of travel of the web of material, at least one additional roll which can be displaced into the path of the web of material in such a way that the angle of wrap of the web of material on the heated press roll increases, said at least one additional roll be pressed against the heated press roll by a device with a force that is substantially less than a force applied in the nip by the pair of press rolls.

2. Calender assembly according to claim 1, wherein at least one other displaceable roll is arranged at a distance downstream of the nip in the direction of travel of the web of material to improve characteristics of the web of material.

3. Calender assembly according to claim 2, wherein one of the displaceable roll is a guide roll.

4. Calender assembly according to claim 3, wherein the at least one other displaceable guide roll and an expander roll which is also displaceable are arranged one behind the other in the direction of the web.

5. Calender assembly according to claim 4, wherein the displacement of at least one of the displaceable rolls and the expander roll is adjustable for the purpose of adapting the angle of wrap to the web material.

6. Calender assembly according to claim 1, wherein the angle of wrap in front of the nip is at least 20°.

7. Calender assembly according to claim 1, wherein the angle of wrap behind the nip is at least 20°.

* * * * *